US012798629B2

(12) United States Patent
Kimura

(10) Patent No.: US 12,798,629 B2
(45) Date of Patent: Nov. 17, 2026

(54) RAIL VEHICLE CAR BODY WALL STRUCTURE

(71) Applicant: Hitachi, Ltd., Tokyo (JP)

(72) Inventor: Sota Kimura, London (GB)

(73) Assignee: Hitachi, Ltd., Tokyo (JP)

( * ) Notice: Subject to any disclaimer, the term of this patent is extended or adjusted under 35 U.S.C. 154(b) by 618 days.

(21) Appl. No.: 18/225,839

(22) Filed: Jul. 25, 2023

(65) Prior Publication Data

US 2024/0101164 A1 Mar. 28, 2024

(30) Foreign Application Priority Data

Sep. 26, 2022 (EP) ..... 22197674

(51) Int. Cl.
*B61D 17/08* (2006.01)
*B61D 17/00* (2006.01)

(52) U.S. Cl.
CPC ..... *B61D 17/08* (2013.01); *B61D 17/005* (2013.01)

(58) Field of Classification Search
CPC ..... B61D 17/08; B61D 17/005
See application file for complete search history.

(56) References Cited

U.S. PATENT DOCUMENTS

2012/0042805 A1* 2/2012 Umebayashi ..... B29C 70/845 105/396
2016/0347377 A1 12/2016 Minei

FOREIGN PATENT DOCUMENTS

| | | | |
|---|---|---|---|
| JP | 2002-264803 | A | 9/2002 |
| JP | 2008-63758 | A | 3/2008 |
| JP | 2013-86588 | A | 5/2013 |
| JP | 2018-140637 | A | 9/2018 |
| KR | 10-2014-0031293 | A | 3/2014 |
| WO | WO 2010/116677 | A1 | 10/2010 |
| WO | WO 2012/150091 | A1 | 11/2012 |

OTHER PUBLICATIONS

Japanese-language Office Action issued in Japanese Application No. 2023-129869 dated Sep. 3, 2024 with English translation (9 pages).

* cited by examiner

*Primary Examiner* — Robert J McCarry, Jr.
(74) *Attorney, Agent, or Firm* — Crowell & Moring LLP

(57) ABSTRACT

A wall structure for forming a wall of a rail vehicle car body, the wall structure comprising a metal panel having an aperture formed therein; and a fibre-reinforced-plastic (FRP) strengthening system attached to the metal panel at a corner of the aperture. The FRP strengthening system comprises a stack of FRP laminae arranged such that, progressing through the stack starting from a base lamina, the area of each lamina in the stack is less than that of the previous lamina.

14 Claims, 9 Drawing Sheets

RAIL VEHICLE CAR BODY WALL STRUCTURE

FIELD OF THE INVENTION

The present invention relates to a wall structure for forming a wall of a rail vehicle car body.

BACKGROUND

Rail vehicles, in particular electrified rail vehicles, have a lower environmental impact than other forms of transport, such as cars. This is in part due to their greater passenger density, meaning that their power consumption per unit distance per passenger is lower than other forms of transport.

However, in order to further reduce the power consumption associated with trains and other rail vehicles, and thereby reduce the carbon footprint associated with the operation of such vehicles, there is an ongoing incentive to reduce the mass of these vehicles.

A known approach to reducing the mass of rail vehicles is to reduce the mass of the car body structure of the rail vehicles. Typically, walls of the car body are fabricated from metal panels. By reducing the gauge of the metal panels, or using a lower density material, the mass of the car body can be reduced. As illustrated, for example, by JP2002264803A, such walls can be constructed from a double-skinned material with ribs extending between two metal panels, allowing the gauge of material used in the panels to be further reduced whilst the ribs help to provide adequate strength and stiffness. However, it is still necessary for the car body to be able to withstand the stresses placed on it by both its own weight and the running loads on the vehicle.

Apertures formed in the walls of the car body, for example for windows, doors, ventilation and the like, give rise to areas of stress concentration around such aperture. The problem of stress concentration is particularly acute at aperture corners, as these act to further concentrate stress in the surrounding metal panels.

Thus, when seeking to reduce the mass of a car body, it is often the stress in the vicinity of apertures in the car body, and in particular at the corners of such apertures, that is the limiting factor in how much the mass of the car body can be reduced through material selection and/or reduction in material thickness.

To address this limiting factor, it is known to reinforce the regions of the metal panels surrounding such apertures with fibre-reinforced-plastic (FRP) components that are bonded to the metal panels in those regions and act to strengthen the walls in areas where stress concentration is greatest. Such a structure allows the mass of the metal panels to be reduced whilst still providing a car body that is able to withstand the stresses that will be exerted on it during use.

However, existing car body wall structures making use of FRP components are not optimised with regards to strength-to-mass ratio. Moreover, car body structures making use of FRP components also have the problem that an adhesive layer that bonds an FRP component to the metal panel is often placed under a high stress due to the difference in the coefficients of thermal expansion between the material of the FRP component and metal of the panel; there is therefore a risk of delamination between the FRP component and the panel.

The present invention has been devised in light of the above considerations.

SUMMARY OF THE INVENTION

In a first aspect of the present disclosure, there is provided a wall structure for forming a wall of a rail vehicle car body.

The wall structure comprises: a metal panel having an aperture formed therein; and a fibre-reinforced-plastic (FRP) strengthening system attached to the metal panel at a corner of the aperture. The FRP strengthening system comprises a stack of FRP laminae arranged such that, progressing through the stack starting from a base lamina, the area of each lamina in the stack is less than that of the previous lamina. Advantageously, by providing a wall structure having such a multi-layer FRP strengthening system, the strength-to-mass ratio of the FRP strengthening system can be improved in comparison to FRP strengthening systems which have e.g. just a single FRP lamina of uniform thickness. Moreover, the amount of FRP used within the wall structure can be reduced, in turn reducing the environmental impact associated with production of the FRP system. Furthermore, the peak stresses induced by the difference in the coefficient of thermal expansion (CTE) between the material of the FRP system and the metal of the panel can be reduced by the progressive reduction in area of the stacked laminae. In particular, the progressive area reduction allows a gradual transition of the thickness of the FRP system from a minimum thickness at an edge of the system to a maximum thickness at a more central position of the system, the gradual transition helping to spread and reduce peak stresses, which can in turn reduce the likelihood of delamination of the FRP system from the panel.

The laminae of the FRP strengthening system may be sized such that, progressing through the stack starting from a base lamina, the area of each successive lamina in the stack is a threshold percentage or less of the area of the previous lamina. The threshold percentage may be 80%, and preferably may be 70% or 60%.

The laminae of the FRP strengthening system may be shaped such that, progressing through the stack starting from the base lamina, the boundary of each successive lamina lies entirely within the boundary of the previous lamina when viewed in the stacking direction.

The FRP system may comprise only two laminae, whereby progressing through the stack starting from the base lamina, the base lamina is a first lamina and the next lamina is a second lamina. However, the FRP system may comprise more than two laminae, in which case, progressing through the stack of laminae starting from the base lamina, the base lamina is a first lamina, the next lamina is a second lamina, the subsequent lamina is a third lamina and so on. The number of laminae of the FRP system may be determined according to considerations such as the desired amount of strengthening of the metal panel by the FRP system, the desired mass of the resulting wall structure, the available space for the system, the difference in CTE etc.

The fibres within the FRP strengthening system may comprise, for example, any one or more of carbon fibres, glass fibres, and aramid fibres. The fibres are typically continuous fibres. Each lamina may be formed from one or more fibres layers, e.g. in the form of lay-up prepreg sheets. Within each layer, the fibres may be multi-directional, e.g. woven, or unidirectional.

The resin matrix within the FRP strengthening system may comprise, for example, any one or more of epoxy, acrylic and urethane resin.

The metal panel may be formed, for example, of aluminium alloy or steel (e.g. stainless steel).

The wall structure may comprise plural FRP strengthening systems. For example, the aperture, such as a substantially rectangular aperture, may have plural corners, and each FRP strengthening system may be attached to the metal panel at a respective corner of the aperture. Additionally, or alternatively, the wall structure may comprise plural apertures, each with one or more FRP strengthening systems.

The aperture may be a window aperture. In contrast, although the FRP strengthening system can also be applied to door apertures, as these are generally larger than window apertures they tend to require more substantial, e.g. metal-based, strengthening and stiffening systems.

The stacked laminae of the FRP strengthening system may be bonded together to form a monolithic FRP strengthening system attached to one side of the metal panel. The base lamina of the stack is then typically the lamina within the stack that is closest to the metal panel. In the context of a wall structure used to form a single skinned, rail vehicle car body wall, such a monolithic FRP strengthening system is typically attached to the interior side of the metal panel, where conveniently it can be covered by non-structural, decorative internal panelling.

Alternatively, where the FRP system is not a monolithic FRP strengthening system, the base lamina of the FRP strengthening system may be attached to one side of the metal panel, and another lamina in the stack may be attached to the other side of the metal panel to sandwich the metal panel between the laminae. In the context of a wall structure used to form a double skinned rail vehicle car body wall having spaced exterior and interior metal panels, the base lamina may be attached to a side of the interior metal panel that faces into the car body and another lamina in the stack may be attached to the interior metal panel on the opposite side thereof (i.e. located in the cavity between the interior metal panel and the exterior metal panel). This arrangement allows the amount of interior volume of the car body occupied by the FRP system to be reduced. Plural ribs may extend between the exterior metal panel and the interior metal panel. In such a case, a lamina located in the cavity between the interior metal panel and the exterior metal panel may have one or more finger portions which extend between adjacent ribs.

The edge of the FRP strengthening system closest to the corner of the aperture may be offset from the periphery thereof to leave a margin of metal panel at the corner of the aperture which is uncovered by the FRP strengthening system. This margin can be filled with an edge fillet of adhesive, which helps to form a stronger bond between the FRP system and the metal panel. In addition, such a margin allows for greater tolerance between the shape of the aperture corner and the shape of the FRP system. A suitable width for the margin of metal panel at the corner of the aperture depends on factors, such as mechanical properties of the metal panel, FRP and adhesive material, but may be at least 1 mm and/or at most 20 mm.

The edges of the laminae of the FRP strengthening system which are closest to the corner of the aperture may coincide when viewed in their stacking direction.

The base lamina of the FRP system may have: a first fibre direction that is substantially aligned with the longitudinal direction of the car body; and a second fibre direction that is substantially tangentially aligned with the periphery of the aperture at the corner. Such an arrangement of fibres within the base lamina can be particularly effective increasing the wall structure's bending and shear stiffness and strength at the corner of the aperture. Other fibre directions, if present, may be selected, for example, to reduce warping deformations induced by temperature changes during manufacture.

The wall structure may further comprise an elastic, e.g. rubbery, adhesive material that bonds the FRP strengthening system to the metal panel, the elastic adhesive material being relatively compliant compared to the FRP strengthening system and the metal panel. Such an adhesive material can further reduce peak stresses induced by differences in CTE, and thus reduce the risk of the FRP strengthening system delaminating from the metal panel. Moreover, the elastic adhesive material can have damping properties that reduce the amount of vibration and noise transmitted through the wall structure from the outside of the rail vehicle car body. The elastic adhesive material may comprise, for example, any one or more of epoxy, acrylic and urethane adhesive. In general, a low elastic modulus for the adhesive material, allows reductions in its bonding thickness and the size of any offset of the edge of the FRP strengthening system from the periphery of the corner of the aperture.

Where the wall structure comprises plural FRP strengthening systems, two adjacent FRP strengthening systems may be for, respectively, adjacent corners of a same aperture (e.g. adjacent upper and lower corners of the aperture) and the base laminae of the adjacent FRP strengthening systems may be formed from a single lamina which extends unbroken from corner to corner of said same aperture. Advantageously, such a structure can increase the bending strength and stiffness of the wall structure in the region between the adjacent corners of the aperture. In addition, it allows the number of components to be attached to the metal panel to be reduced, simplifying manufacture of the wall structure. The portion of the base lamina of the FRP strengthening system extending from corner to corner may have a fibre direction that is substantially aligned with the direction between the two adjacent corners along which the base lamina extends.

Additionally or alternatively, where the wall structure comprises plural FRP strengthening systems and the metal panel comprises plural apertures, two adjacent FRP strengthening systems may be for, respectively, adjacent corners of neighbouring apertures (e.g. two adjacent upper corners or two adjacent and lower corners), and the base laminae of the adjacent FRP strengthening systems may be formed from a single lamina which extends unbroken from corner to corner of said neighbouring apertures. Advantageously, such a structure can increase the shear strength and stiffness of the wall structure in the region between the two neighbouring apertures. In addition, it allows the number of components to be attached to the metal panel to be reduced, simplifying manufacture of the wall structure. The portion of the base lamina of the FRP strengthening system extending from the corner of one aperture to the corner of the other aperture may have a fibre direction that is substantially aligned with the direction between the two adjacent corners along which the base lamina extends. Advantageously, this can further improve the increase in bending stiffness provided by the structure.

In wall structures such as those described above in which the base laminae of adjacent FRP strengthening systems are formed from a single lamina which extends unbroken between the FRP strengthening systems, one or more further laminae outside the FRP strengthening systems at the corners of the aperture(s) may be stacked on the single lamina forming the base laminae. This allows the metal panel to be significantly strengthened and stiffened at other regions away from the corners of the aperture(s).

The wall structure may form a sidewall of a rail vehicle car body.

In a second aspect of the present disclosure, there is provided a rail vehicle car body having a wall formed with a wall structure according to the first aspect of the present disclosure. The second aspect may incorporate any of the optional features set out above with respect to the first aspect.

The invention includes the combination of the aspects and preferred features described except where such a combination is clearly impermissible or expressly avoided.

SUMMARY OF THE FIGURES

Aspects and embodiments of the present disclosure will now be discussed with reference to the accompanying figures in which.

DETAILED DESCRIPTION OF THE INVENTION

Aspects and embodiments of the present disclosure will now be discussed with reference to the accompanying figures. Further aspects and embodiments will be apparent to those skilled in the art.

Figure 1:
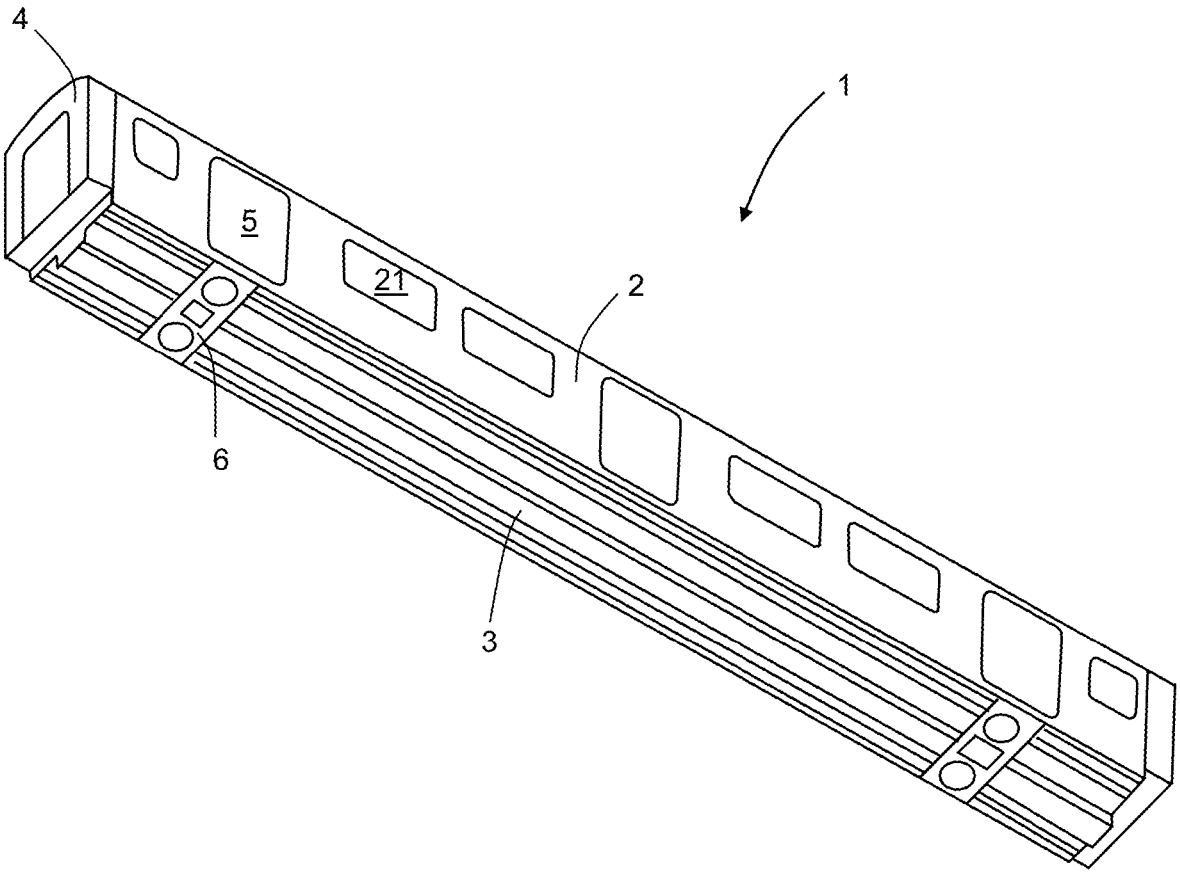
FIG. 1 illustrates a train car body.

FIG. 1 is a schematic perspective view from beneath a train car body 1. The body has sidewalls 2, a floor 3, a roof (not shown in FIG. 1) and end walls 4. Door apertures 5 and window apertures 21 are formed in the sidewalls. Underfloor bolster beams 6 for attachment of bogies are provided beneath the floor 3. The train car body uses a wall structure, described in more detail below, to form the sidewalls 2. However, the same or similar structure can also be used, where appropriate, to form any of the floor 3, roof, end walls 4, and internal bulkheads when present.

Figure 2:
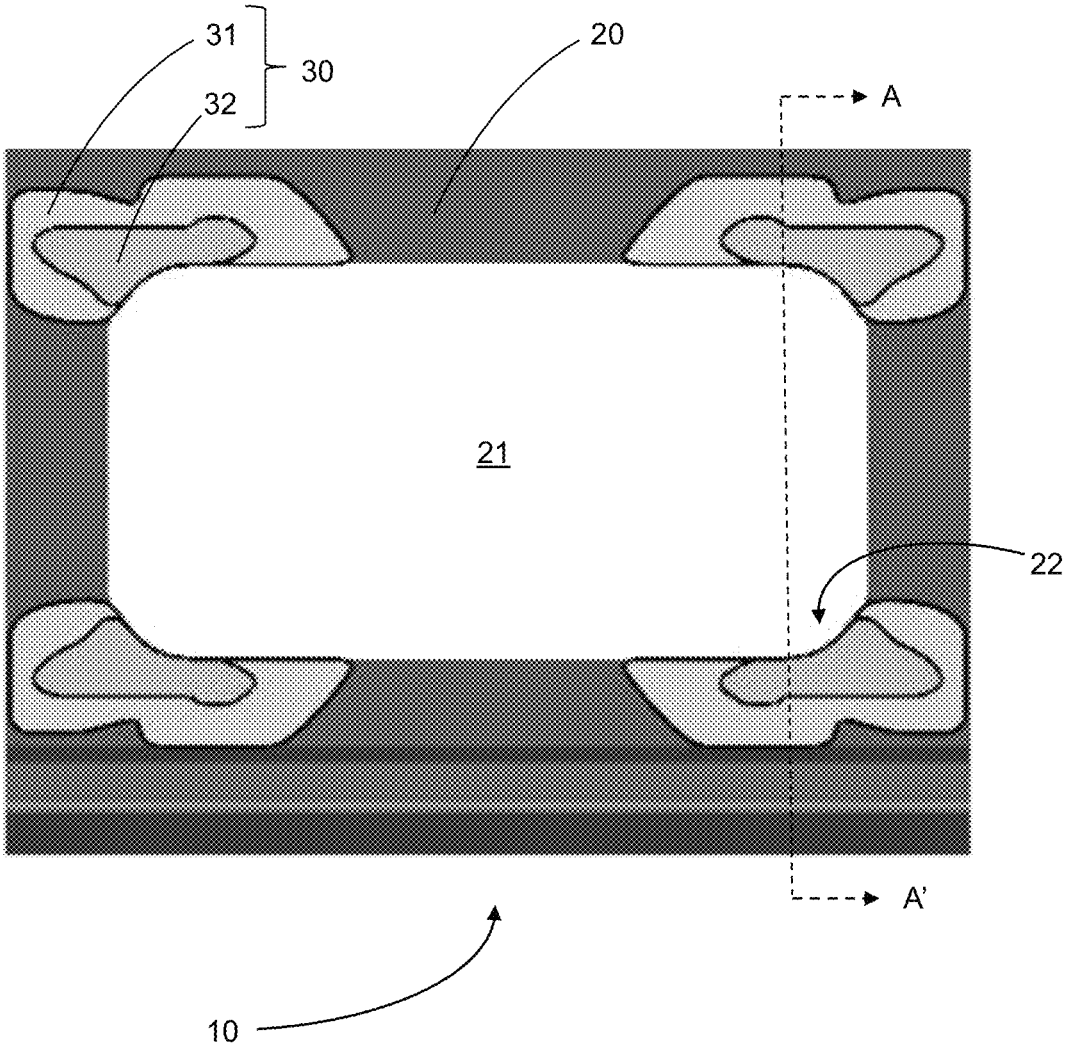
FIG. 2 illustrates part of a wall structure for forming a sidewall of a train car body.

FIG. 2 illustrates part of a wall structure 10 for forming a sidewall 2 of such a train car body 1. The wall structure 10 comprises a metal panel 20 having the window apertures 21 formed therein, and a plurality of fibre-reinforced-plastic (FRP) strengthening systems 30 attached to the metal panel 20 at respective corners 22 of each aperture 21. However, the present invention is not limited to a strengthening system for window apertures and it can be appreciated that a variety of different types of aperture may be provided on a train car body (e.g. emergency escape hatches, access hatches, doors, ventilation holes etc.) to which the strengthening system may be applied.

The metal panel 20 is typically fabricated from aluminium alloy, but may also be fabricated from steel, such as stainless-steel. The train car body provides the structural shell of a carriage, inside which passengers are transported. It is important that the car body can withstand the forces exerted on it by its own weight and from running loads of the train. In particular, the stresses in the car body, supported at both ends on the bolster beams 6, are analogous to a beam bending under its own weight and producing shear stresses acting both along the length of the car body and in a generally vertical direction.

The window apertures 21 in the metal panel 20 reduce the overall stiffness of the panel, and increase the loads that have to be carried by the remaining metal. Moreover, the corners 22 of the apertures 21 act as stress raisers in the regions of the metal panel 20 adjacent the corners 22.

As shown in FIG. 2, to counter these issues the wall structure 10 has, at each of the corners 22 of the aperture 21 in the metal sheet 20, a respective FRP strengthening system 30 attached to the metal sheet 20. The FRP strengthening systems 30 locally strengthen and stiffen the wall structure at the corners 22 so that the thickness of the metal sheet 20 can be reduced without compromising the ability of the wall structure to withstand the forces acting upon it.

Each FRP strengthening system 30 is multi-layered, comprising a stack of laminae 31, 32 arranged such that, progressing through the stack starting from a base lamina 31, the area of each lamina in the stack is less than that of the previous lamina. In the example of FIG. 2, each FRP system 30 comprises a first (base) lamina 31 and a second lamina 32. However, other FRP systems 30 may comprise three or more stacked laminae, each successive lamina having a smaller area than the preceding one. As already mentioned, a first benefit of this wall structure 10 is that it reduces the load on the metal panel 20 in the vicinity of the corners 22 of the aperture 21 so that the metal panel 20 can be made thinner. Moreover, by progressively decreasing the area of the laminae through the stack, the fibre and resin material used within the FRP system 30 can be focused on those regions of the panel 20 where the strengthening and stiffening requirement is highest, reducing the amount of fibre and resin material that would otherwise be used if the FRP strengthening system were of uniform thickness throughout. This improves the strength-to-mass ratio and the strength-to-cost ratio of the wall structure 10.

The fibres used in the FRP system 30 may comprise, for example, any one or more of carbon fibres, glass fibres, and aramid fibres. The resin used in the FRP system 30 may comprise, for example, any one or more of epoxy, acrylic and urethane resin. Factors informing the choice of fibre and choice of resin may include stiffness, strength, toughness, mass, cost and coefficient of thermal expansion (CTE).

The laminae in the FRP strengthening systems 30 of FIG. 2 are also shaped such that, progressing through the stack from the first (base) lamina 31, the boundary of the second lamina 32 lies entirely within the boundary of the first (base) lamina 31.

In addition to saving material, another advantage of the present FRP system's structure relates to the thermal stresses that arise in metal-FRP structures. Typically, known FRP components used to strengthen and stiffen metal panels 20 in train car bodies are attached to the metal panel 20 using an adhesive layer. However, the typical metal alloys used in the walls of train car bodies such as aluminium alloys and steel, have a CTE that is substantially larger than that of the materials in the FRP components.

The differential expansion of the metal panel 20 and FRP component caused by the difference in CTE of their materials can generate large peak stresses in the adhesive layer attaching them together. Either, or both of, the magnitude of the peak stress and the cycling of the stress from the cycling of the temperature can cause the adhesive layer to fail and the FRP component to delaminate from the metal panel 20, the result being that the FRP component no longer strengthen and stiffens the metal panel 20.

Figure 3:
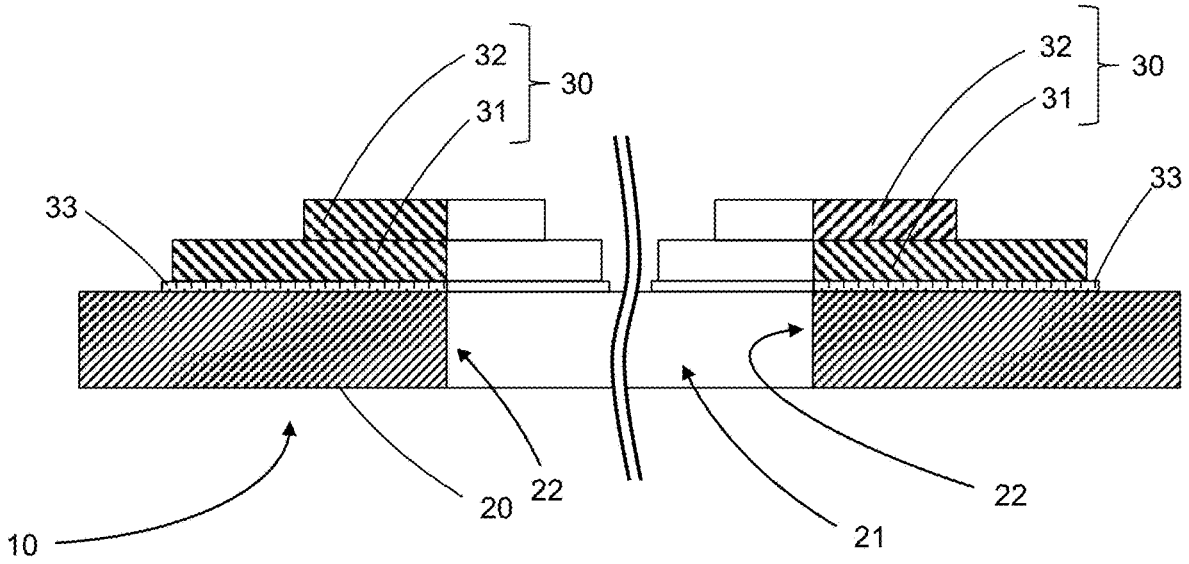
FIG. 3 provides a cross section of the wall structure of FIG. 2 along the line A-A'.

FIG. 3 illustrates a cross section of the wall structure 10 of FIG. 2 along the line A-A', where the FRP system 30 is attached to the metal panel 20 by an adhesive layer 33. In FIG. 3 the thickness of the stack of laminae within the FRP system 30 is non-uniform over the area of the metal panel 20 to which the FRP system 30 is attached. When moving through the stack from the base lamina 31, each successive lamina has a smaller area than the preceding lamina; the progressive reduction in area of the laminae allows a gradual transition of the thickness of the FRP system from a minimum thickness at an edge of the system to a maximum thickness at a more central position of the system, the gradual transition helping to spread and reduce peak stresses generated in the adhesive layer 33 from differential thermal expansion and contraction. Thus, the risk of the FRP system 30 delaminating from the metal panel 20 and the reliability of the wall structure 10 is improved.

Moreover, the material of the adhesive layer 33 in FIG. 3 is highly elastic (e.g. rubbery), and more compliant than the FRP system 30 and metal panel 20 such that the adhesive layer 33 can elastically, and therefore reversibly, deform to accommodate differential thermal expansion and contraction.

However, as shown in FIGS. 2 and 3, within a given FRP strengthening system 30 and when viewed along the stacking direction of that system, the edges of the laminae closest to the corner 22 of the aperture 21 are typically aligned with each other. As the component of in-plane stresses in the adhesive layer 33 and the metal panel 20 perpendicular to the line of the periphery of the aperture must fall to zero at the periphery, this alignment of laminae edges does not necessarily increase the stresses generated in the adhesive layer.

Figure 4:
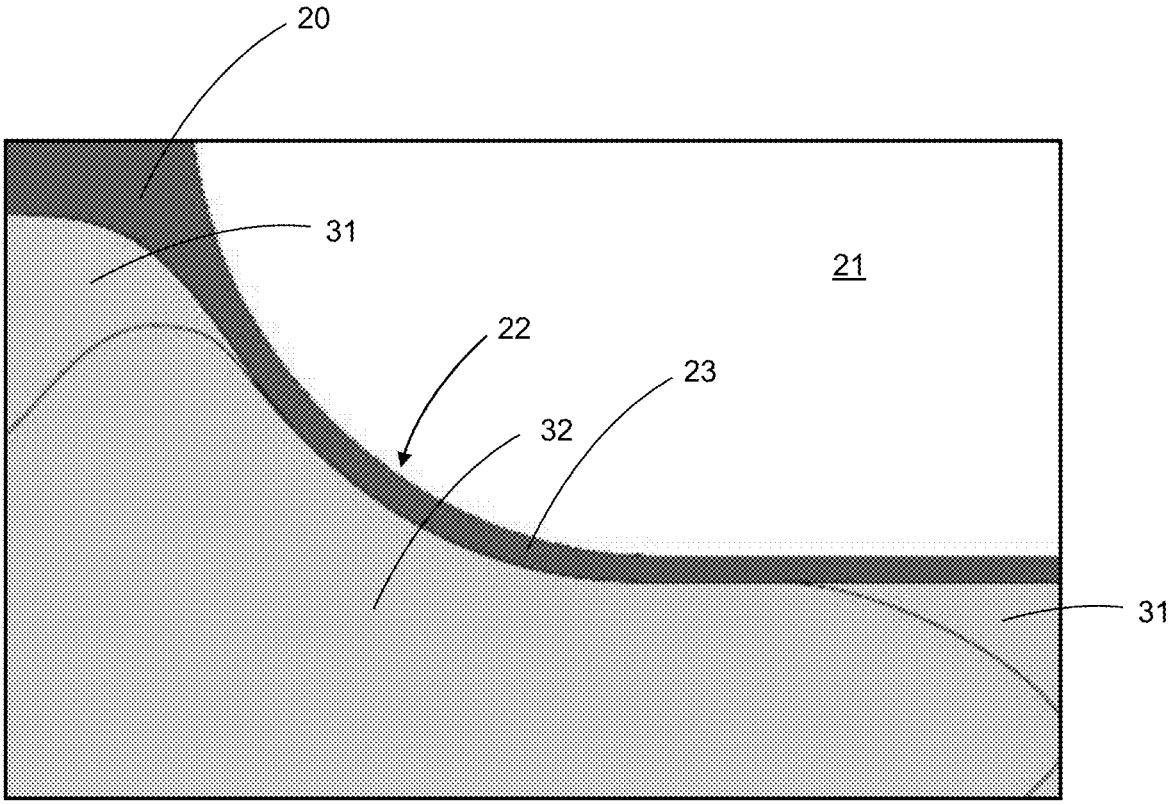
FIG. 4 provides a detailed view of an FRP strengthening system of the wall structure of FIG. 2.

In FIG. 3, the FRP system 30 is attached to the metal panel 20 such that the aligned edge of the stack of laminae is also aligned with the periphery of the aperture 21. FIG. 4 illustrates a possible alternative arrangement, wherein the FRP system 30 is attached to the metal panel 20 such that the aligned laminae edges of the FRP system 30 are offset from the periphery of the aperture 21 to leave a margin 23 of metal at the corner 22 of the aperture 21 that is not covered by the FRP strengthening system 30. This margin 23 can be filled with an edge fillet of adhesive, which helps to form a stronger bond between the FRP system 30 and the metal panel 20 and allows for greater tolerance between the shape of the aperture corner 22 and the shape of the FRP system 30. As long as the width of the margin is relatively small, the aligned edges of the laminae along the margin do not significantly increase the stresses generated in the adhesive layer 33.

The orientation of the fibres within the laminae of the FRP system 30 can also influence the strength and stiffness of the FRP system 30 in different directions and thus the properties of the resulting wall structure 10. For example, the base lamina 31 may contain fibres roughly aligned with two directions: a first fibre direction that is substantially aligned with the longitudinal direction of the car body (i.e. horizontally in FIG. 2) and a second fibre direction that is substantially tangentially aligned with the periphery of the aperture 21 at the corner 22. Having fibres aligned in both the first and second fibre directions within the base lamina 30 increases the bending stiffness and strength and shear stiffness and strength of the resulting FRP system 30 and wall structure 10. Similarly, the fibre directions in the one or more additional laminae forming the FRP system 30 can be selected in order to influence the strength and stiffness of the FRP system 30.

The wall structure 10 illustrated in FIGS. 2, 3 and 4 is constructed by the stacked laminae 31, 32 of each FRP system 30 being bonded together to form a monolithic FRP system 30 that is then attached to one side of the metal panel 20. However, FIGS. 5 and 6 illustrate a variant the wall structure 10.

Figure 5:
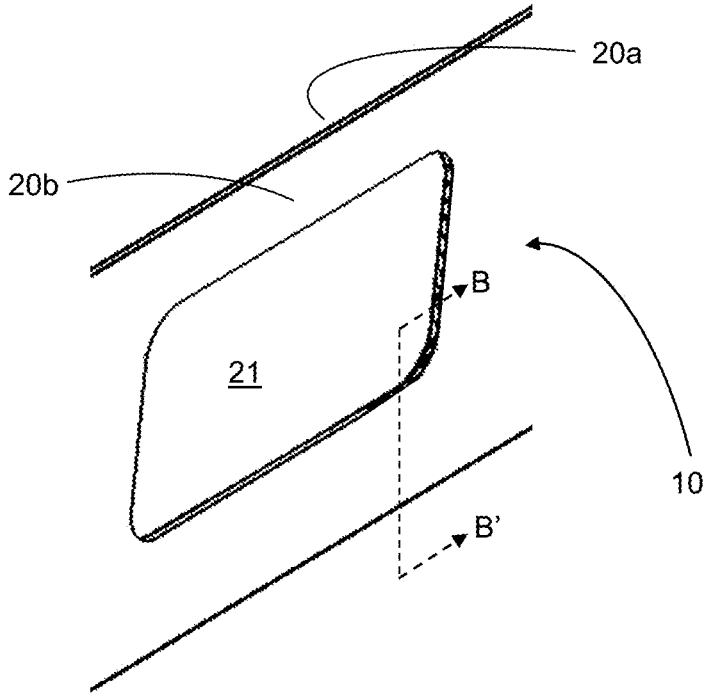
FIG. 5 illustrates part of a double-skinned wall structure for forming a sidewall of a train car body.
Figure 6:
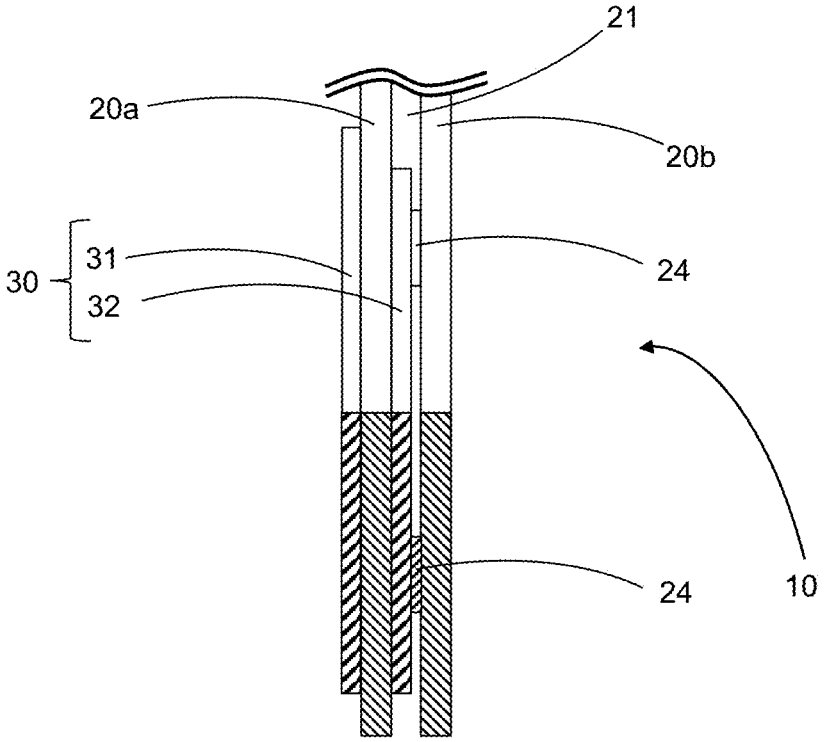
FIG. 6 provides a cross section of the wall structure of FIG. 5 along the line B-B'.

The wall structure 10 in FIGS. 5 and 6 is double skinned, having spaced interior 20*a* and exterior 20*b* metal panels. Ribs 24, which extend parallel to each other along the longitudinal direction of the car body, also extend across the cavity between the interior metal panel 20*a* and exterior metal panel 20*b* to stiffen and strengthen the wall structure 10. In FIG. 6, the base lamina 31 of the FRP system 30 is attached to the interior-facing side of the interior metal panel 20*a*, whilst the second lamina 32, is attached to the other side of the interior metal panel 20*a*, i.e. in the cavity between the interior 20*a* and exterior 20*b* metal panels. Thus the base lamina 31 and the second lamina 32 sandwich the interior metal panel 20*a*. In the case that an FRP system 30 comprises more than two laminae, the additional laminae may be positioned on either side of the metal panel 20. Whilst the variant of the wall structure 10 illustrated in FIGS. 5 and 6 requires additional lamina-to-panel attachment operations, particularly for a double skinned wall structure it can increase the available interior space within the train car body because the number of laminae on the interior-facing side of the interior metal panel 20*a* is reduced.

Figure 7A:
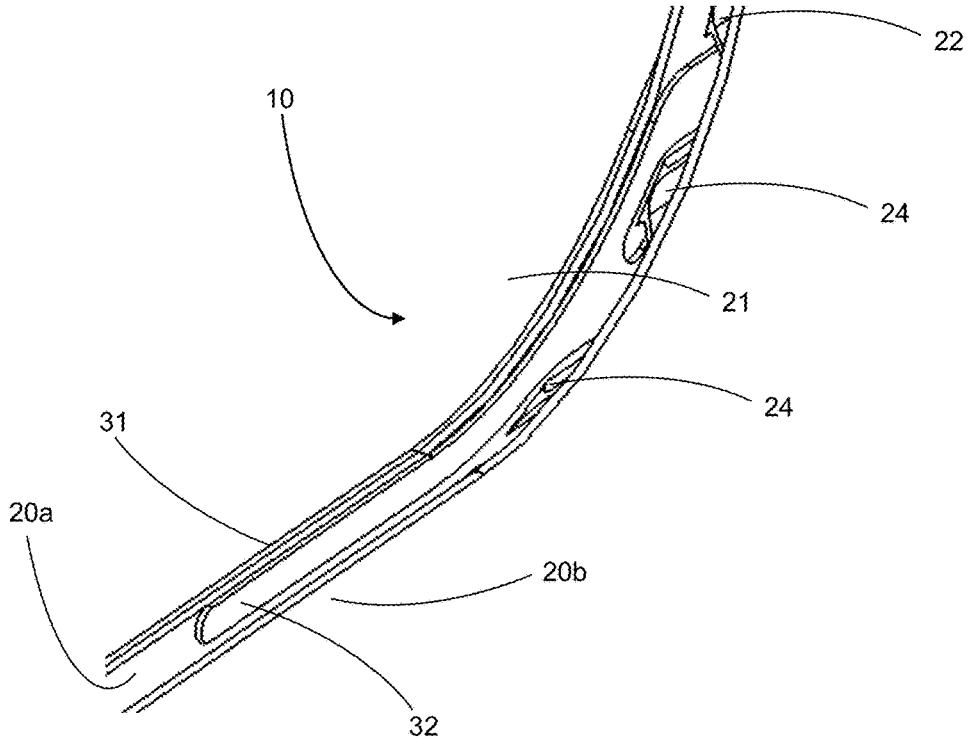
FIG. 7A provides a detailed view of an FRP strengthening system of the wall structure of FIG. 5, FIG. 7B provides a detailed view of a base lamina of the FRP strengthening system.
Figure 7B:
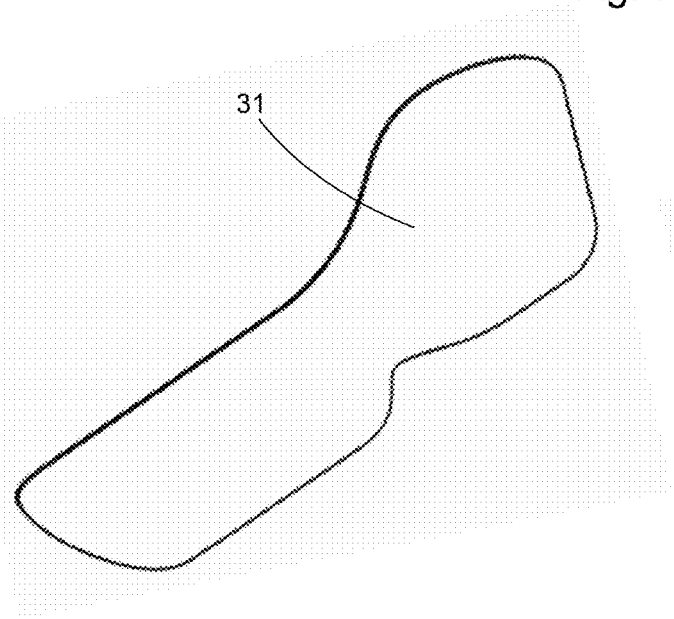
FIG. 7C provides a detailed view of a second lamina of the FRP strengthening system.
Figure 7C:
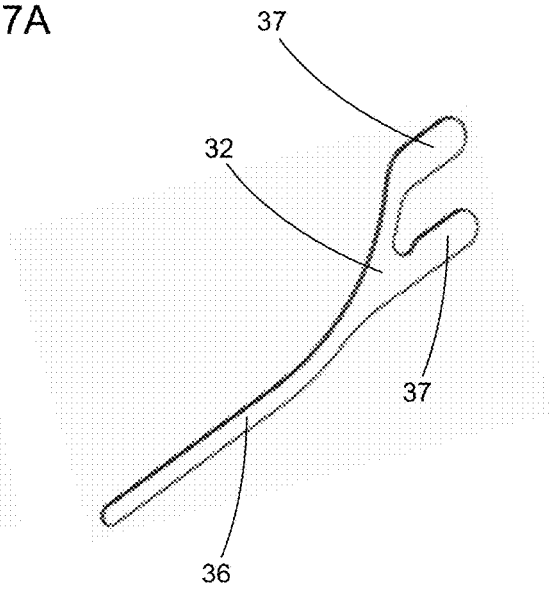

FIG. 7A shows more detail of the variant wall structure 10, and particularly the FRP system 30, of FIGS. 5 and 6. FIG. 7B illustrates the shape of the base lamina 31 and FIG. 7C illustrates the shape of the second lamina 32. The stiffening and strengthening ribs 24 stop short of the periphery of the aperture 21 in the interior 20*a* and exterior 20*b* metal panels, such that there is a margin of metal panel 20 adjacent the periphery of the aperture 21 that is uninterrupted by the ribs 24. The base lamina 31 is attached to an interior side of the interior panel 20*a*. The second lamina 32 has a circumferential portion 36 shaped such as to extend along the margin of metal panel 20. The second lamina 32 also has finger portions 37 extending away from the circumferential portion 36 of the lamina 32 such that, when the lamina is attached to the interior metal panel 20*a*, the finger portions 37 extend away from the periphery of the aperture 21 between adjacent ribs 24.

Figure 8:
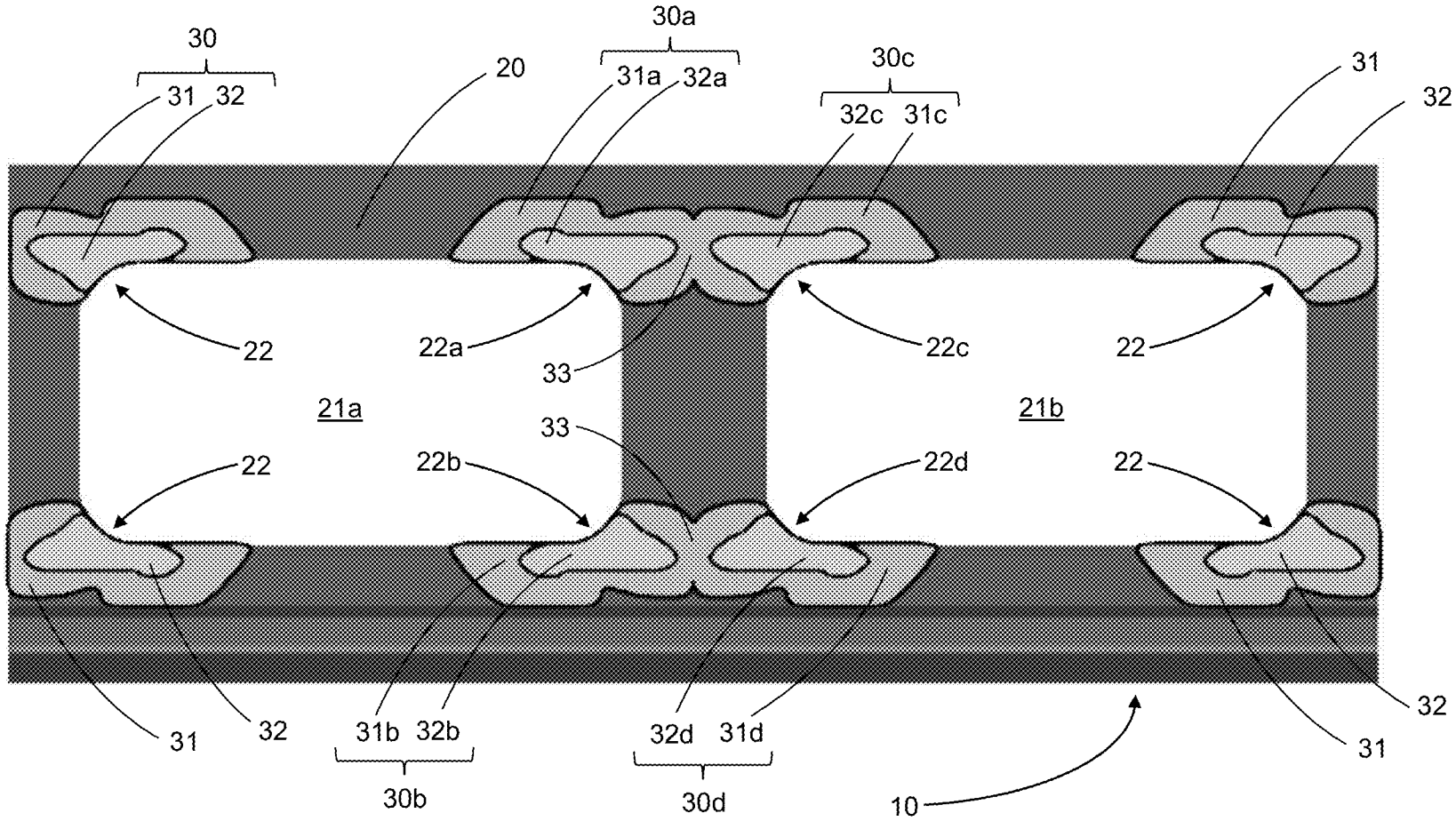
FIG. 8 illustrates part of another wall structure for forming a sidewall of a train car body, the wall structure comprising a plurality of apertures and a plurality of FRP strengthening systems.

FIG. 8 shows part of a variant wall structure 10 having neighbouring apertures 21*a* and 21 *b* which are aligned such that top corners 22*a* and 22*c* of the two apertures are adjacent one another and bottom corners 22*b* and 22*d* of the two apertures are similarly adjacent one another. For a typical car body bending under its own weight, one of the areas of the car body subjected to highest stress is the region of the metal panel 20 that is positioned between two adjacent corners 22 of two neighbouring apertures 21. In FIG. 8, FRP systems 30*a* and 30*c* are attached to the metal panel 20 at adjacent top corners 22*a* and 22*c*, respectively, of the two neighbouring apertures 21*a*, 21*c*. The FRP systems 30*a*, 30*c* each comprise a respective base lamina 31*a*, 31*c* and a respective second lamina 32*a*, 32*c*. In order to increase the shear strength and stiffness of the region of the metal panel 20 positioned between the neighbouring aperture corners 22*a* and 22*c*, the base laminae 31*a*, 31*c* of the adjacent FRP strengthening systems 30*a*, 30*c* is formed from a single lamina which extends unbroken from corner 22*a* to corner 22*c* (i.e. the FRP strengthening systems 30*a* and 30*c* have a common base lamina) to further increase the strength and stiffness of the wall in the high stress region. In addition, this structure reduces the number of components to be bonded to the metal panel 20, simplifying the manufacture of a wall having this wall structure 10. Likewise the FRP systems 30*c*, 30*d* positioned at the two bottom corners 22*b* and 22*d* of the same apertures 21*a*, 21*c* share a single base lamina which extends unbroken from corner 22*b* to corner 22*d*.

Returning to the fibre directions within the base lamina 31 of an FRP system 30 discussed above in relation to FIG. 2, it can be appreciated that with the wall structure 10 in FIG. 8, the first fibre direction within the unbroken common base lamina of adjacent FRP systems 30 is substantially aligned with the length direction of the car body so that the fibres themselves extend unbroken between adjacent FRP systems. This further increases the strength and stiffness of the resulting FRP systems 30 and wall structure 10.

Figure 9:
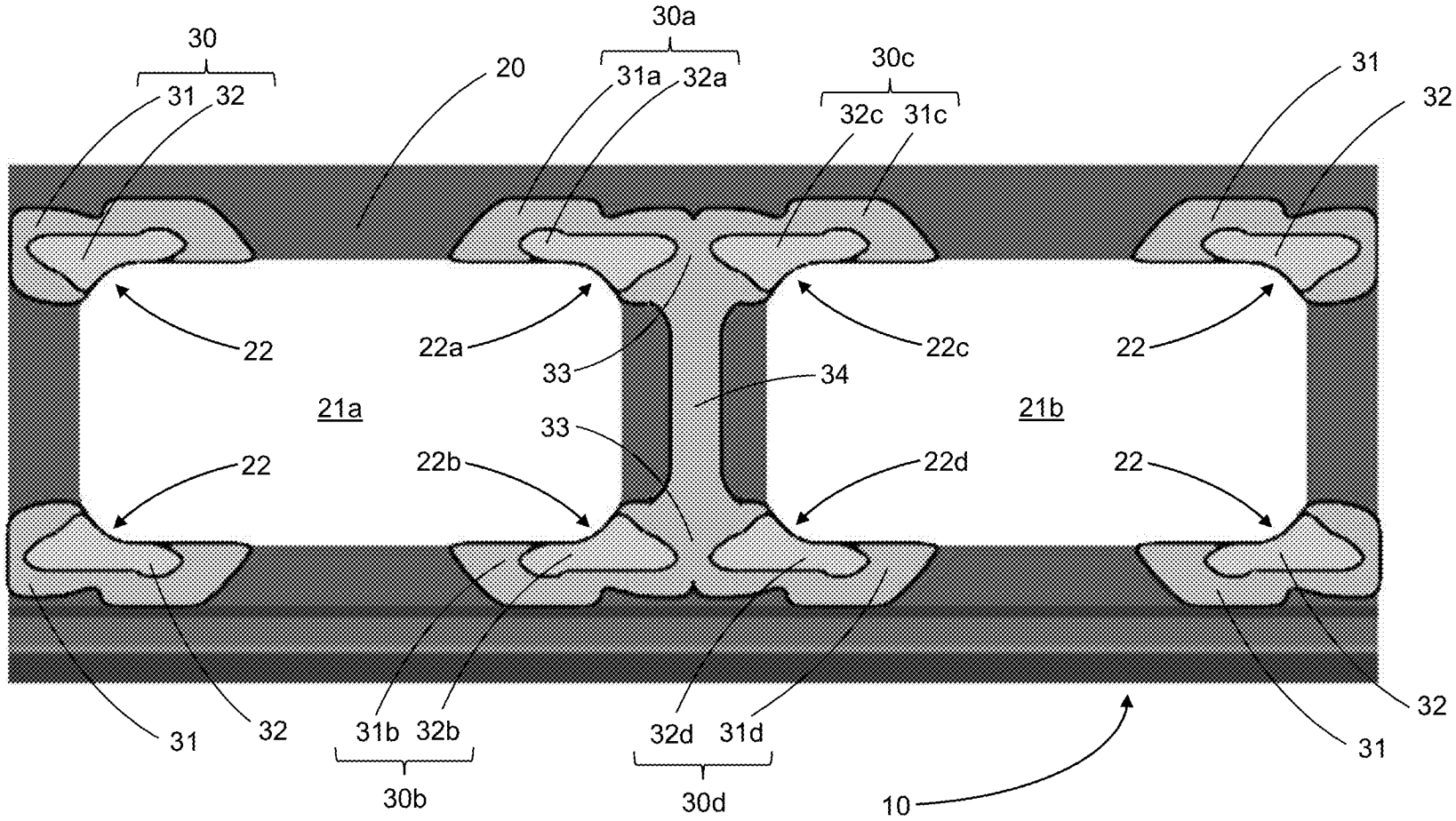
FIG. 9 illustrates a variant of the wall structure illustrated in FIG. 8.

FIG. 9 shows part of a variant of the wall structure 10 illustrated in FIG. 8. The FRP systems 30*a* and 30*b* form part of the wall structure 10 and are attached to the metal panel 20 at adjacent corners 22*a* and 22*b*, respectively, of the same aperture 21*a*. Similarly, FRP systems 30*c* and 30*d* form part of the wall structure 10 and are attached to the metal panel 20 at adjacent corners 22*c* and 22*d*, respectively, of a second aperture 21*c*. Each of the four FRP systems 30*a-d* comprises a respective base lamina 31*a-d* and a respective second lamina 32*a-d*. As in FIG. 8, the base laminae 31 of the FRP systems 30 attached to the metal panel 20 at adjacent corners 22 of neighbouring apertures 21 are formed from a single lamina which extends unbroken from the corner 22 of one aperture 21 to the adjacent corner 22 of the neighbouring aperture 21. The wall structure 10 of FIG. 9 differs from that of FIG. 8 by the base laminae 31*a* and 31 *b* of FRP systems 30*a* and 30*b*, which are attached to the metal panel 20 at adjacent corners 22*a*, 22*b* of the same aperture 21*a*, being formed from a single lamina that comprises a central portion 34 extending unbroken between the two adjacent corners 22*a* and 22*b*. Additionally, the base laminae 31*c* and 31*d* of FRP systems 30*c* and 30*d*, which are attached to the metal panel 20 at adjacent corners 22*c*, 22*d* of the same aperture 21*c*, are formed from the same single lamina as that of FRP systems 30*a* and 30*b*. Accordingly, the base laminae 31*a-d* of FRP systems 30*a-d* are all formed from a single lamina that extends unbroken between the four corners 22*a-d* of the two apertures 21*a*, 21*c* that neighbour each other (i.e. all four FRP systems 30*a-d* in FIG. 9 have a common base lamina 30). Relative to the wall structure shown in FIG. 8, the wall structure 10 of FIG. 9 also increases the bending stiffness and strength in the area of the metal panel 20 extending between adjacent corners of the same aperture.

Where a common base lamina 30 extends between adjacent corners 22 of the same aperture 21, a third fibre direction can be present within the unbroken common base lamina 30. This third fibre direction is substantially aligned with the direction in which the central portion 34 of the common base lamina extends (i.e. vertically in FIG. 9) so that again the fibres themselves extend unbroken between adjacent FRP systems. This further increases the bending stiffness and strength of the resulting FRP systems 30 and wall structure 10.

Figure 10:
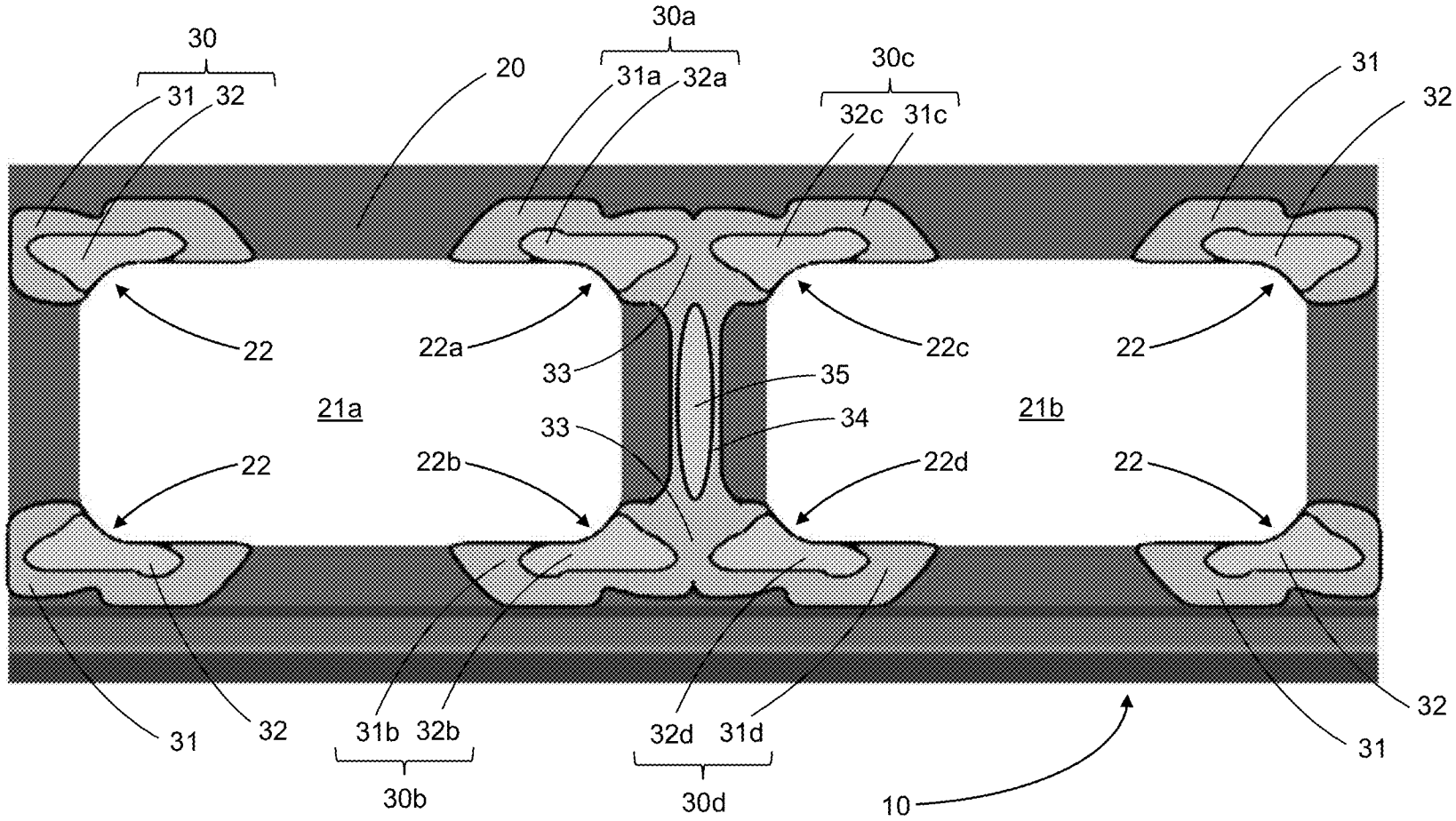
FIG. 10 illustrates a further variant of the wall structure illustrated in FIG. 8.

FIG. 10 shows part of a variant of the wall structure 10 illustrated in FIG. 9 in which a further lamina 35, extrinsic to the FRP strengthening systems, is stacked on the single lamina forming the base laminae 31*a-d* of the four adjacent FRP strengthening systems 30*a-d*. The further lamina 35 is positioned on the central portion 34 of the common base lamina. Advantageously, this allows the further lamina 35 to contribute to increasing the bending stiffness and strength of the wall structure 10. However, the position of the further lamina 35 is not necessarily limited to the central portion 34 of the common base lamina Although in FIG. 10 only a single further lamina 35 is illustrated, other further laminae 35 may be stacked on the single lamina forming the base laminae 31 of adjacent FRP systems 30, either within a single stack, or forming multiple further stacks, as required.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example+/−10%.

The invention claimed is:

1. A wall structure for forming a wall of a rail vehicle car body, the wall structure comprising:

a metal panel having an aperture formed therein; and a fibre-reinforced-plastic (FRP) strengthening system attached to the metal panel at a corner of the aperture; wherein the FRP strengthening system comprises a stack of FRP laminae arranged such that, progressing through the stack starting from a base lamina, the area of each lamina in the stack is less than that of the previous lamina.

2. The wall structure according to claim 1, wherein the aperture is a window aperture.

3. The wall structure according to claim 1, wherein:

the stacked laminae of the FRP strengthening system are bonded together to form a monolithic FRP strengthening system attached to one side of the metal panel.

4. The wall structure according to claim 1, wherein:

the base lamina of the FRP strengthening system is attached to one side of the metal panel, and another lamina in the stack is attached to the other side of the metal panel to sandwich the metal panel between the laminae.

5. The wall structure according to claim 4 which is for forming a double skinned wall of a rail vehicle car body, wherein:

the wall structure has spaced exterior and interior metal panels, the base lamina is attached to a side of the interior metal panel that faces into the car body; and another lamina in the stack is attached to the interior metal panel on the opposite side thereof to the base lamina.

6. The wall structure according to claim 1, wherein the edge of the FRP strengthening system closest to the corner of the aperture is offset from the periphery thereof to leave a margin of metal panel at the corner of the aperture which is uncovered by the FRP strengthening system.

7. The wall structure according to claim 1, wherein the edges of the laminae of the FRP strengthening system which are closest to the corner of the aperture coincide when viewed in their stacking direction.

8. The wall structure according to claim 1, wherein the base lamina has:

a first fibre direction that is substantially aligned with the longitudinal direction of the car body; and a second fibre direction that is substantially tangentially aligned with the periphery of the aperture at the corner.

9. The wall structure according to claim 1, wherein an elastic adhesive material bonds the FRP strengthening system to the metal panel, the elastic adhesive material being relatively compliant compared to the FRP strengthening system and the metal panel.

10. The wall structure according to claim 1, wherein the wall structure comprises plural FRP strengthening systems.

11. The wall structure according to claim 10, wherein:

two adjacent FRP strengthening systems are for, respectively, adjacent corners of a same aperture; and the base laminae of the adjacent FRP strengthening systems are formed from a single lamina which extends unbroken from corner to corner of said same aperture.

12. The wall structure according to claim 10, wherein:

the metal panel comprises plural apertures; and two adjacent FRP strengthening systems are for, respectively, adjacent corners of neighbouring apertures, wherein the base laminae of the adjacent FRP strengthening systems are formed from a single lamina which extends unbroken from corner to corner of said neighbouring apertures.

13. The wall structure according to claim 10, wherein one or more further laminae, extrinsic to the FRP strengthening systems at the corners, are stacked on the single lamina forming the base laminae.

14. A rail vehicle car body having a wall formed with a wall structure according to claim 1.

* * * * *